United States Patent [19]

Harris, Jr.

[11] Patent Number: 4,637,849

[45] Date of Patent: Jan. 20, 1987

[54] WATERPROOF AMMONIUM NITRATE FUEL OIL EXPLOSIVES

[75] Inventor: William F. Harris, Jr., Louisville, Ky.

[73] Assignee: Celanese Corporation, New York, N.Y.

[21] Appl. No.: 771,863

[22] Filed: Sep. 3, 1985

[51] Int. Cl.[4] ..... C06B 33/04

[52] U.S. Cl. ..... 149/43; 149/60; 149/61; 149/72; 149/76; 149/83; 149/85

[58] Field of Search ..... 149/46, 43, 60, 61, 149/72, 76, 83, 85

[56] References Cited

U.S. PATENT DOCUMENTS

| | | | |
|---|---|---|---|
| 3,072,509 | 1/1963 | Barnhart et al. | 149/2 |
| 3,153,606 | 10/1964 | Breza et al. | 149/41 |
| 3,190,777 | 6/1965 | Breza et al. | 149/57 |
| 3,235,424 | 2/1966 | Butler | 149/38 |
| 3,236,180 | 2/1966 | Towle | 102/22 |
| 3,287,189 | 11/1966 | Wilson et al. | 149/8 |
| 3,296,042 | 1/1967 | Quadflieg et al. | 149/7 |
| 3,639,184 | 2/1972 | Grant | 149/44 |
| 3,640,784 | 2/1972 | Yancik et al. | 149/44 |
| 3,713,919 | 1/1973 | Tomic | 149/60 |
| 3,890,171 | 6/1975 | Jessop | 149/44 |
| 4,071,467 | 1/1978 | Nordgren | 149/44 |
| 4,128,442 | 12/1978 | Barlow | 149/44 |

OTHER PUBLICATIONS

Kirk-Othmer, Encyclopedia of Chemical Technology—Third Edition—vol. 9, pp. 600-604.

*Primary Examiner*—Stephen J. Lechert, Jr.
*Attorney, Agent, or Firm*—Herbert P. Price

[57] ABSTRACT

Waterproof explosive compositions are made from blends of inorganic oxidizing salts, fuel oil and polygalactomannans plus crosslinkers. When exposed to water, the polygalactomannans and crosslinkers form gels which protect the explosive composition from penetration of water and the dissolution of the inorganic oxidizing salt.

10 Claims, No Drawings

WATERPROOF AMMONIUM NITRATE FUEL OIL EXPLOSIVES

BACKGROUND OF THE INVENTION

The field of art to which this invention pertains is explosive and thermic compositions or charges.

For many years water soluble inorganic oxygen supplying salts, such as nitrates, chlorates and perchlorates, have been used in explosive compositions. Ammonium nitrate and sodium nitrate, in particular, find extensive use in commercial high explosives and blasting agents. Of necessity, such explosives often are stored under conditions of high relative humidity and are used under wet conditions. The hygroscopicity and water solubility of the inorganic oxygen supplying salts are undesirable characteristics which may lead to deterioration of the explosive composition and to failures in use.

Because of this deteriorating action, extensive precautions are taken to exclude water from such compositions, not only during formulation, but also in packaging, storage and use, or to at least minimize the amount of water entering the composition. Hence, these products have been packed in waterproof closed metal containers, in highly water resistant laminated fiberboard containers, in heavily waxed paper cartridges, or in water resistant plastic films.

One of the most widely used explosives is based upon ammonium nitrate and fuel oil which is called ANFO in the industry. Such explosive compositions being based on ammonium nitrate must be kept dry in order to be useful. As pointed out in U.S. Pat. No. 3,153,606, such explosive compositions have been blended with finely divided water-dispersible starches and gums. When first contacted with water, such gums form a paste in the outer part of the explosive which paste retards the rate of water penetration into the interior of the charge and prevents segregation of the original components of the mixture and detonation failures. If exposed to moisture over an extended time period, however, the moisture tends to penetrate into the interior of the explosive composition and, thereby, ruining it or at least decreasing its explosive effectiveness.

The present invention provides waterproof explosive compositions which can tolerate extended exposure to moisture.

SUMMARY OF THE INVENTION

This invention is directed to inorganic oxidizing salt-fuel oil explosive compositions. In one aspect, this invention pertains to explosive compositions which are able to withstand exposure to moisture and water. In another aspect, this invention relates to explosive compositions which contain crosslinkable polygalactomannans in combination with the inorganic oxidizing salt and fuel oil.

In preparing the compositions of this invention, the inorganic oxidizing salt and the fuel oil are blended with the polygalactomannan and a suitable crosslinking agent. When exposed to water, either in finely divided form or in prilled form, the polygalactomannan hydrates and crosslinks forming a water-resistant gel around the oxidizing salt which prevents further penetration and solubilization of the oxidizing salt.

The explosive compositions of this invention contain about 83 to about 94.5 weight percent inorganic oxidizing salt, about 4 to about 7 weight percent fuel oil and about 1.5 to about 10 weight percent polygalactomannan and crosslinking agents. A preferred composition contains about 88 to about 94.5 weight percent ammonium nitrate, about 4 to about 7 weight percent fuel oil and about 1.5 to about 5 weight percent guar gum plus crosslinking agent.

DESCRIPTION OF THE INVENTION

The inorganic oxidizing salts useful in this invention include ammonium, alkali metal and alkaline earth metal nitrates, perchlorates, sulfates and the like. Specific examples of commonly employed salts are ammonium nitrate, ammonium perchlorate, sodium nitrate, sodium perchlorate, potassium nitrate, potassium perchlorate, mangnesium nitrate, mangnesium perchlorate, calcium nitrate and the like. Mixtures of these salts can be used. The preferred salt is ammonium nitrate.

The fuel oils useful in this invention are petroleum based oils such as kerosene fuel oils, lubricating oils and other relatively high flash point crude oil fractions including crude oil itself. The preferred fuel is No. 2 fuel oil. Additional fuels which can be used in combination with the fuel oil include aluminum powder, sawdust, coal dust, flour, wood pulp, dextrine, starch, sulfur and the like. Up to about 50 weight percent of fuel oil can be substituted with the additional fuel.

The polygalactomannans useful in this invention are guar gum and locust bean gum and derivatives of these gums. Guar gum is the milled endosperm of the seeds of the leguminous plant, *Cyamopris tetragonolobus.* Locust bean gum is the milled endosperm of the seeds of the plant, *Ceratonia siliqua.* Derivatives of these gums include the hydroxyalkyl derivatives, e.g., hydroxyethyl and hydroxypropyl, carboxymethyl and carboxyethyl derivatives, carboxymethyl-hydroxypropyl derivatives and the like. The preferred polygalactomannan for use in this invention is guar gum.

Crosslinking agents which are used in combination with the polygalactomannans are any of the well-known polyfunctional reagents which react with the cis-hydroxyls of the polygalactomannans. Suitable crosslinking agents are disclosed in U.S. Pat. No. 3,301,723 which is hereby incorporated by reference. Disclosed crosslinkers are the ions of scandium, titanium, vanadium, chromium, manganese, iron, yttrium, zirconium, niobium, lanthanum, hafnium and tantalum. These metal ions are used to crosslink polygalactomannans at pH's of about 6–13.

Additional crosslinking agents are disclosed in U.S. Pat. No. 4,033,415, which is hereby incorporated by reference. Such disclosed crosslinkers contain the ions lead (II), arsenic (III), tin (II), antimony (III), antimony (V), titanium (IV), manganese (VII), chromium (VI), tantalum (V) and niobium (V). Specific crosslinking agents include antimony oxide which cross-links the polygalactomannans at a pH above 7; lead chromate, pH above 8; potassium antimony tartrate and potassium dichromate, pH 2.5–7; potassium pyroantimonate, pH of 5 or lower; and potassium permanganate, pH above 5.

Another well-known crosslinking agent for polygalactomannans is the borate ion which crosslinks at alkaline pH.

Generally, about 0.005 to about 5 millimoles of crosslinking agent are used per one gram of polygalactomannan.

A preferred crosslinking agent for use in this invention is potassium pyroantimonate.

In order to adjust the pH to the range within which crosslinking occurs, various buffers, i.e., acids or bases, can be incorporated in the compositions of this invention. Such buffers include fumaric acid, sulfamic acid, citric acid, oxalic acid, sodium acid fumarate, disodium acid citrate, trisodium citrate, sodium hydroxide, sodium bicarbonate, sodium carbonate and the like.

Ammonium nitrate fuel oil (ANFO) blasting agents are typically prepared by spraying fuel oil onto prilled ammonium nitrate in a solids mixer such as a ribbon blender or rotating cylinder. The fuel oil is absorbed into the pores of the ammonium nitrate prills. After absorption of the fuel oil, the galactomannan, crosslinker and suitable pH buffers, if needed, are added to the mixer and blending is continued until the mixture is uniform. This mixture is referred to as a waterproof ammonium nitrate fuel oil explosive, or blasting agent.

This waterproof ammonium nitrate fuel oil explosive is then placed in a dewatered bore hole which contains a blasting cap and booster which contains high explosives connected to a blasting cord. After the hole has been charged with the blasting agent, the explosives are covered with sand, rocks and the like.

This mixture will resist desensitization resulting from water leaching into the bore hole unlike materials without the galactomannan and crosslinker. Therefore, this invention may be used in many areas in which conventional ammonium nitrate fuel oil explosives fail due to water desensitization.

In the examples, mixtures of ammonium nitrate fuel oil (ANFO) blasting agents were dry blended with the galactomannan and crosslinkers; pH buffers were also added, when necessary, to achieve rapid crosslinking rates. The resulting mixture was blended until uniform. In all examples "ANFO" consisted of:

| | |
|---|---|
| Prilled Ammonium Nitrate | 94% by weight |
| No. 2 Fuel Oil | 6% by weight |

Parts and percentages used in examples are parts and percentages by weight.

The test for the degree of water resistance consists of adding water to a column of the water resistant ANFO blend. In this test 200 grams of waterproof ANFO mixture was added to a 500 ml graduated cylinder. The waterproof ANFO was tamped. 100 ml of water were added to the cylinder. At 15 minutes after water addition, the column of blasting agent was examined visually for the amount of water penetration. This is expressed in millimeters depth of penetration.

EXAMPLE 1

Guar flour was blended with potassium pyroantimonate, fumaric acid and monosodium phosphate. This is known as the premix. The composition of the premix is:

| | |
|---|---|
| Guar Flour | 92.75% |
| Potassium Pyroantimonate | 4.25% |
| Fumaric Acid | 2.00% |
| Monosodium Phosphate | 1.00% |

The premix was blended with ANFO in varying proportions and the water resistance was measured as described above.

| | | | | | |
|---|---|---|---|---|---|
| Grams ANFO | 200 | 198 | 194 | 190 | 180 |
| Grams Premix | 0 | 2 | 6 | 10 | 20 |
| Depth of Water Penetration (MM) | 60 | 30 | 10 | 2 | 1 |

EXAMPLE 2

Guar flour was blended with Borax (sodium tetraborate decahydrate) as follows:

| | |
|---|---|
| Guar Flour | 90% |
| Borax | 10% |

The above premix was blended with ANFO in varying proportions and the water resistance was measured as described above.

| | | | | | |
|---|---|---|---|---|---|
| Grams ANFO | 200 | 198 | 194 | 190 | 180 |
| Grams Premix | 0 | 2 | 6 | 10 | 20 |
| Depth of Water Penetration (MM) | 60 | 50 | 20 | 5 | 5 |

EXAMPLE 3

For purposes of comparison with Example 1 and 2, guar flour, without crosslinker, was blended with ANFO in varying proportions and the water resistance was measured as described above.

| | | | | | |
|---|---|---|---|---|---|
| Grams ANFO | 200 | 198 | 194 | 190 | 180 |
| Grams Guar Flour | 0 | 2 | 6 | 10 | 20 |
| Depth of Water Penetration | 60 | 55 | 40 | 20 | 10 |

In this example, no distinct resistant barrier was formed. The decrease in water penetration was due to an increase in the viscosity of the water, thereby limiting penetration. In a system containing a crosslinker, the resistance is due to the formation of a water resistant barrier formed by the reaction of guar flour and the appropriate crosslinker.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A waterproof explosive composition consisting essentially of a nonaqueous blend of:

(a) an inorganic oxidizing salt;

(b) fuel oil; and (c) a polygalactomannan plus crosslinker wherein (a), (b) and (c) are present in the amount of about 83 to about 94.5 weight percent (a), about 4 to about 7 weight percent (b), and about 1.5 to abuot 10 weight percent (c), said percentages being based on the total weight of (a), (b) and (c).

2. The composition of claim 1 wherein the inorganic oxidizing salt is present in the amount of about 88 to about 94.5 weight percent, the fuel oil is present in the amount of about 4 to about 7 weight percent and the polygalactomannan plus crosslinker is present in the amount of about 1.5 to about 5 weight percent.

3. The composition of claim 1 which contains a pH buffer.

4. The composition of claim 1 wherein the inorganic oxidizing salt is selected from the group consisting of ammonium, alkali metal and alkaline earth metal nitrates, perchlorates and sulfates.

5. The composition of claim 1 wherein the inorganic oxidizing salt is ammonium nitrate.

6. The composition of claim 1 wherein the fuel oil is a petroleum based oil.

7. The composition of claim 1 wherein up to about 50 weight percent fuel oil is substituted with another fuel selected from the group consisting of aluminum powder, sawdust, coal dust, flour, wood pulp, dextrine, starch and sulfur.

8. The composition of claim 1 wherein the polygalacomannan is guar gum.

9. The composition of claim 8 wherein the crosslinker for the guar gum is potassium pyroantimonate.

10. The composition of claim 9 which contains fumaric acid as a pH buffer.

* * * * *

UNITED STATES PATENT AND TRADEMARK OFFICE

Certificate

Patent Number: 4,637,849

Patented: January 20, 1987

On petition requesting issuance of a certificate of correction of inventorship pursuant to 35 USC 256, it has been found that the above-identified patent, through error and without and deceptive intent, improperly sets forth the inventorship. Accordingly, it is hereby certified that the correct inventorship of this patent is:
William F. Harris, Jr. and Gerald L. Schrock Signed and sealed this 20th Day of March, 1990

BROOKS HUNT

*Supervisory Patent Examiner*
*Art Unit 224*